US011600242B2

(12) United States Patent
Chen et al.

(10) Patent No.: US 11,600,242 B2
(45) Date of Patent: Mar. 7, 2023

(54) SINGLE-STAGE GATE DRIVING CIRCUIT WITH MULTIPLE OUTPUTS AND GATE DRIVING DEVICE

(71) Applicants: Interface Technology (ChengDu) Co., Ltd., Sichuan (CN); Interface Optoelectronics (ShenZhen) Co., Ltd., Guangdong (CN); Interface Optoelectronics (Wuxi) Co., Ltd., Jiangsu (CN); General Interface Solution Limited, Miaoli County (TW)

(72) Inventors: Po-Lun Chen, Guangdong (CN); Chun-Ta Chen, Guangdong (CN); Chih-Lin Liao, Guangdong (CN); Fu-Cheng Wei, Guangdong (CN); Po-Tsun Liu, Guangdong (CN); Guang-Ting Zheng, Guangdong (CN); Ting-Yu Wei, Guangdong (CN)

(73) Assignees: Interface Technology (ChengDu) Co., Ltd., Sichuan (CN); Interface Optoelectronics (ShenZhen) Co., Ltd., Guangdong (CN); Interface Optoelectronics (Wuxi) Co., Ltd., Jiangsu (CN); General Interface Solution Limited, Miaoli County (TW)

( * ) Notice: Subject to any disclaimer, the term of this patent is extended or adjusted under 35 U.S.C. 154(b) by 144 days.

(21) Appl. No.: 17/204,965

(22) Filed: Mar. 18, 2021

(65) Prior Publication Data

US 2022/0246106 A1 Aug. 4, 2022

(30) Foreign Application Priority Data

Feb. 4, 2021 (CN) ..... 202110154648.4

(51) Int. Cl.
*G09G 3/36* (2006.01)

(52) U.S. Cl.
CPC ..... *G09G 3/3677* (2013.01); *G09G 2310/08* (2013.01); *G09G 2320/041* (2013.01); *G09G 2330/08* (2013.01)

(58) Field of Classification Search
None
See application file for complete search history.

(56) References Cited

U.S. PATENT DOCUMENTS 11,468,863 B2 * 10/2022 Chen ..... G09G 3/3677

* cited by examiner

*Primary Examiner* — Ifedayo B Iluyomade
(74) *Attorney, Agent, or Firm* — CKC & Partners Co., LLC

(57) ABSTRACT

A single-stage gate driving circuit with multiple outputs includes a first bootstrapping circuit, a first pre-charge circuit, a first output control circuit, a second bootstrapping circuit, a second pre-charge circuit, and a second output control circuit. During a first duration, the first pre-charge circuit precharges a first node to a first voltage. During a second duration, the first bootstrapping circuit boosts the first node from the first voltage to a second voltage, and the second pre-charge circuit precharges a second node to a fourth voltage. During a third duration, the first output control circuit boosts the first node from the second voltage to a third voltage, and the second bootstrapping circuit boosts the second node from the fourth voltage to a fifth voltage. During a fourth duration, the second output control circuit boosts the second node from the fifth voltage to a sixth voltage.

20 Claims, 5 Drawing Sheets

SINGLE-STAGE GATE DRIVING CIRCUIT WITH MULTIPLE OUTPUTS AND GATE DRIVING DEVICE

RELATED APPLICATIONS

This application claims priority to China Application Serial Number 202110154648.4, filed Feb. 4, 2021, the disclosures of which are incorporated herein by reference in their entireties.

BACKGROUND

Field of Invention

The present invention relates to a single-stage gate driving circuit with multiple outputs. More particularly, the present invention relates to a single-stage gate driving circuit with multiple outputs of a display device, and a gate driving device.

Description of Related Art

Thin Film Transistor Liquid Crystal Displays (TFT LCDs) have become the mainstream of the display products. TFT-LCDs are applied in mobile phones and are lightweight and easy to carry. The requirement of TVs or display panel with medium and large size has gradually increased in recent years. In comparison with Poly-Si TFT LCDs, the a-Si TFT LCDs could reduce the production cost, and the a-Si TFT LCDs can be fabricated on a large-area glass substrate at low temperature. The a-Si TFT LCDs have simple manufacturing processes and high uniformity and can increase the production rate.

With the concept of System-on-Glass (SOG) being proposed in recent years, each of many display products integrates the display driver circuit (e.g., gate drivers or scan drivers) on the glass substrate, i.e., the gate driver on array (GOA) circuit. Using the GOA circuit to perform scanning has many advantages, in comparison with the traditional gate IC, for high-resolution products, the GOA circuit not only can reduce the area of the border of the display to meet the requirements of the display with a narrow border, but also can reduce the number of the gate scan drive integrated circuits (ICs), thereby reducing the cost of the ICs to improve market competitiveness and avoiding disconnection problem when bonding the glass substrate and ICs such that the product yield could be improved. At present, the GOA circuit has been widely applied in small-sized or medium-sized display products (e.g., mobile phones, notebook computers, TVs, etc.), and even the application of GOA can be seen in high-resolution display products with the development of technology.

With the development of the panel industry, the design of borders of display products is becoming narrower, in which, the said display products may be small-sized cell phones or medium/large-sized vehicle panels. It is hoped that several mechanisms can be used to reduce the number of transistors so as to save unnecessary layout area, such that the GOA products have better cost advantage in manufacturing and is more competitive with respect to the specification and prices.

In order to realize higher display levels, the high-resolution panels are gradually being introduced. In the case that the number of frames is fixed, the time that each scan line can be operated is reduced in proportion to the resolution. Further, due to the requirements of high/low temperature operation and long-time operation, the design of GOA circuits needs to be more rigorous. However, the carrier mobility of a-Si is relatively low, and thus the reliability target that needs to be considered is to improve the driving capability of the gate driving circuit while passing the stress test at high temperatures (e.g., 85° C.).

In order to reduce manufacturing costs and achieve a more simple display so as to meet the designed requirement of GOA of the mid-size panel, and in order to pass product reliability verification and test of product stability, there is a need to design a gate driving circuit with a smaller layout area and high reliability to extreme temperature.

SUMMARY

The present invention provides a single-stage gate driving circuit with multiple outputs including a first bootstrapping circuit, a first pre-charge circuit, a first output control circuit, a second bootstrapping circuit, a second pre-charge circuit, and a second output control circuit. The first pre-charge circuit is connected to the first bootstrapping circuit through a first node. The first pre-charge circuit precharges a first node to a first voltage during a first duration. The first bootstrapping circuit boosts the first node from the first voltage to a second voltage during a second duration. The first output control circuit is connected to the first bootstrapping circuit and the first pre-charge circuit through the first node. The first output control circuit boosts the first node from the second voltage to a third voltage during a third duration. The second bootstrapping circuit is connected to the first output control circuit. The second pre-charge circuit is connected to the second bootstrapping circuit through a second node. The second pre-charge circuit precharges the second node to a fourth voltage during the second duration. The second bootstrapping circuit boosts the second node from the fourth voltage to a fifth voltage during the third duration. The second output control circuit is connected to the second bootstrapping circuit and the second pre-charge circuit through the second node. The second output control circuit boosts the second node from the fifth voltage to a sixth voltage during a fourth duration.

In accordance with one or more embodiments of the invention, the first pre-charge circuit includes a first transistor. A first terminal of the first transistor is connected to the first node. A second terminal of the first transistor receives a high system voltage.

In accordance with one or more embodiments of the invention, the single-stage gate driving circuit with multiple outputs further includes a discharge circuit including a second transistor. A first terminal of the second transistor is connected to the first node. A second terminal of the second transistor receives a first low system voltage.

In accordance with one or more embodiments of the invention, the first output control circuit includes a third transistor. A control terminal of the third transistor is connected to the first node and a first terminal of the third transistor receives a first clock signal, such that the third transistor generates a first gate driving signal at a second terminal of the third transistor.

In accordance with one or more embodiments of the invention, the first bootstrapping circuit is composed of a first bootstrapping capacitor and a fourth transistor. A first terminal of the first bootstrapping capacitor is connected to the first node. A second terminal of the first bootstrapping capacitor is connected to a first terminal of the fourth transistor.

In accordance with one or more embodiments of the invention, the second bootstrapping circuit is composed of a second bootstrapping capacitor and a fifth transistor. A first terminal of the second bootstrapping capacitor is connected to the second node. A second terminal of the second bootstrapping capacitor is connected to a first terminal of the fifth transistor. A second terminal of the fifth transistor is connected to the second terminal of the third transistor to receive the first gate driving signal.

In accordance with one or more embodiments of the invention, the second pre-charge circuit includes a sixth transistor. A first terminal of the sixth transistor is connected to the second node. A second terminal of the sixth transistor receives the high system voltage.

In accordance with one or more embodiments of the invention, the second output control circuit includes a seventh transistor. A control terminal of the seventh transistor is connected to the second node and a first terminal of the seventh transistor receives a second clock signal, such that the seventh transistor generates a second gate driving signal at a second terminal of the seventh transistor.

In accordance with one or more embodiments of the invention, the single-stage gate driving circuit with multiple outputs further includes a first anti-noise circuit including an eighth transistor and a ninth transistor. A first terminal of the eighth transistor and a first terminal of the ninth transistor are connected to the first node. A second terminal of the eighth transistor and a second terminal of the ninth transistor receive the first low system voltage. A control terminal of the eighth transistor is connected to a third node. A control terminal of the ninth transistor is connected to a fourth node.

In accordance with one or more embodiments of the invention, the single-stage gate driving circuit with multiple outputs further includes a second anti-noise circuit including a tenth transistor and an eleventh transistor. A first terminal of the tenth transistor and a first terminal of the eleventh transistor are connected to the second terminal of the third transistor. A second terminal of the tenth transistor and a second terminal of the eleventh transistor receive the first low system voltage. A control terminal of the tenth transistor is connected to the third node. A control terminal of the eleventh transistor is connected to the fourth node.

In accordance with one or more embodiments of the invention, the single-stage gate driving circuit with multiple outputs further includes a third anti-noise circuit including a twelfth transistor. A first terminal of the twelfth transistor is connected to the second node. A second terminal of the twelfth transistor receives the first low system voltage. A control terminal of the twelfth transistor is connected to the third node.

In accordance with one or more embodiments of the invention, the single-stage gate driving circuit with multiple outputs further includes a fourth anti-noise circuit including a thirteenth transistor and a fourteenth transistor. A first terminal of the thirteenth transistor and a first terminal of the fourteenth transistor are connected to the second terminal of the seventh transistor. A second terminal of the thirteenth transistor and a second terminal of the fourteenth transistor receive the first low system voltage. A control terminal of the thirteenth transistor is connected to the third node. A control terminal of the fourteenth transistor is connected to the fourth node.

In accordance with one or more embodiments of the invention, the single-stage gate driving circuit with multiple outputs further includes a first negative bias compensation circuit including a fifteenth transistor, a sixteenth transistor and a seventeenth transistor. A first terminal and a control terminal of the fifteenth transistor receive the first clock signal. A second terminal of the fifteenth transistor, a first terminal of the sixteenth transistor and a first terminal of the seventeenth transistor are connected to the third node. A control terminal of the sixteenth transistor receives a third clock signal. A control terminal of the seventeenth transistor is connected to the first node. A second terminal of the sixteenth transistor and a second terminal of the seventeenth transistor receive a second low system voltage.

In accordance with one or more embodiments of the invention, the single-stage gate driving circuit with multiple outputs further includes a second negative bias compensation circuit including an eighteenth transistor, a nineteenth transistor and a twentieth transistor. A first terminal and a control terminal of the eighteenth transistor receive the third clock signal. A second terminal of the eighteenth transistor, a first terminal of the nineteenth transistor and a first terminal of the twentieth transistor are connected to the fourth node. A control terminal of the nineteenth transistor receives the first clock signal. A control terminal of the twentieth transistor is connected to the first node. A second terminal of the nineteenth transistor and a second terminal of the twentieth transistor receive the second low system voltage.

In accordance with one or more embodiments of the invention, the second low system voltage is less than the first low system voltage.

In accordance with one or more embodiments of the invention, during the first duration, the first transistor is turned on such that the high system voltage received by the second terminal of the first transistor precharges the first node to the first voltage.

In accordance with one or more embodiments of the invention, during the second duration, the fourth transistor is turned on and a high voltage level is provided to a second terminal of the fourth transistor, such that the first node is boosted from the first voltage to the second voltage, and the sixth transistor is turned on such that the high system voltage received by the second terminal of the sixth transistor precharges the second node to the fourth voltage.

In accordance with one or more embodiments of the invention, during the third duration, the first terminal of the third transistor receives the first clock signal with a high voltage level such that the first node is boosted from the second voltage to the third voltage, and fifth transistor is turned on and the first gate driving signal received by the second terminal of the fifth transistor boosts the second node from the fourth voltage to the fifth voltage.

In accordance with one or more embodiments of the invention, during the fourth duration, the first terminal of the seventh transistor receives the second clock signal with a high voltage level such that the second node is boosted from the fifth voltage to the sixth voltage.

The present invention further provides a gate driving device including a multi-stage of gate driving circuit composed of a plurality of gate driving circuits. Each of the gate driving circuits is configured to output at least two gate driving signals. Each of the gate driving circuits includes a first bootstrapping circuit, a first pre-charge circuit, a first output control circuit, a second bootstrapping circuit, a second pre-charge circuit, and a second output control circuit. The first pre-charge circuit is connected to the first bootstrapping circuit through a first node. The first pre-charge circuit precharges a first node to a first voltage during a first duration. The first bootstrapping circuit boosts the first node from the first voltage to a second voltage during a second duration. The first output control circuit is connected to the first bootstrapping circuit and the first pre-charge circuit through the first node. The first output control circuit boosts the first node from the second voltage to a third voltage during a third duration. The second bootstrapping circuit is connected to the first output control circuit. The second pre-charge circuit is connected to the second bootstrapping circuit through a second node. The second pre-charge circuit precharges the second node to a fourth voltage during the second duration. The second bootstrapping circuit boosts the second node from the fourth voltage to a fifth voltage during the third duration. The second output control circuit is connected to the second bootstrapping circuit and the second pre-charge circuit through the second node. The second output control circuit boosts the second node from the fifth voltage to a sixth voltage during a fourth duration.

In order to let above mention of the present invention and other objects, features, advantages, and embodiments of the present invention to be more easily understood, the description of the accompanying drawing as follows.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Specific embodiments of the present invention are further described in detail below with reference to the accompanying drawings, however, the embodiments described are not intended to limit the present invention and it is not intended for the description of operation to limit the order of implementation. The using of "first", "second", "third", etc. in the specification should be understood for identify units or data described by the same terminology, but are not referred to particular order or sequence.

Figure 1:
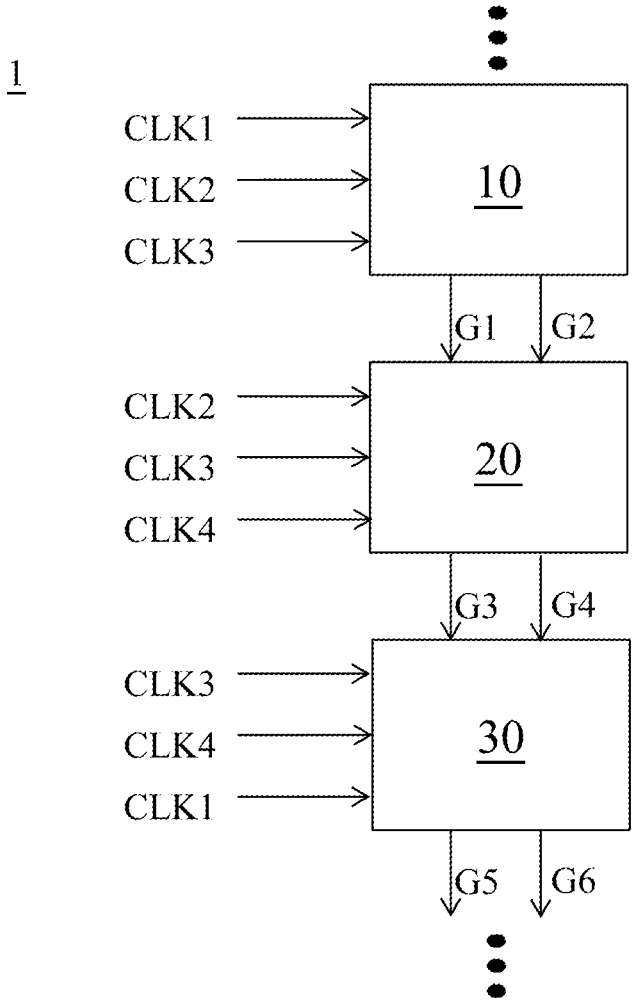
FIG. 1 illustrates a circuit diagram of a gate driving device according to some embodiments of the present invention.

The gate driving device of the present invention includes a multi-stage of gate driving circuit composed of a plurality of gate driving circuits. Each of the gate driving circuits is configured to output at least two gate driving signals. FIG. 1 illustrates a circuit diagram of a gate driving device 1 according to some embodiments of the present invention. The gate driving device 1 as shown in FIG. 1 is composed of the series-connected gate driving circuits 10, 20, and 30. Each of the gate driving circuits 10, 20, and 30 outputs two gate driving signals. For example, the 1st-stage of gate driving circuit 10 outputs the gate driving signals G1 and G2, and the 2nd-stage of gate driving circuit 20 outputs the gate driving signals G3 and G4, and the 3rd-stage of gate driving circuit 30 outputs the gate driving signals G5 and G6. It is noted that the number of the gate driving circuits and the number of the gate driving signals outputted by each of the gate driving circuits as shown in FIG. 1 are merely one example of the present invention, and the present invention is not limited thereto.

As shown in FIG. 1, the 1st-stage of gate driving circuit 10 receives three clock signals CLK1, CLK2, and CLK3, and the 2nd-stage of gate driving circuit 20 receives three clock signals CLK2, CLK3, and CLK4, and the 3rd-stage of gate driving circuit 30 receives three clock signals CLK3, CLK4, and CLK1, and so on. For example, in another embodiment of the present invention, when the number of the gate driving circuits of the gate driving device is more than 3, the 4th-stage of gate driving circuit receives three clock signals CLK4, CLK1, and CLK2.

Figure 2:
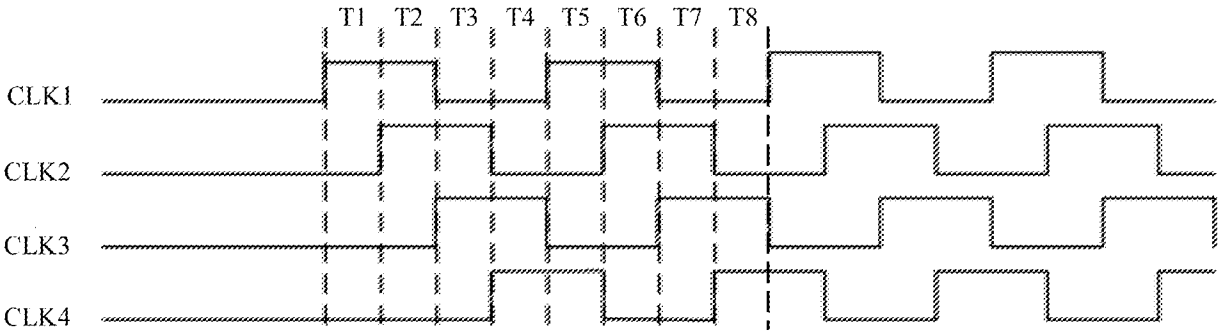
FIG. 2 illustrates a timing chart of the clock signals according to some embodiments of the present invention.

FIG. 2 illustrates a timing chart of the clock signals CLK1, CLK2, CLK3, and CLK4 according to some embodiments of the present invention. As shown in FIG. 2, the time interval that the clock signal CLK1 is at the high voltage level partially overlaps with the time interval that the clock signal CLK2 is at the high voltage level, and the time interval that the clock signal CLK2 is at the high voltage level partially overlaps with the time interval that the clock signal CLK3 is at the high voltage level, and the time interval that the clock signal CLK3 is at the high voltage level partially overlaps with the time interval that the clock signal CLK4 is at the high voltage level.

Figure 3:
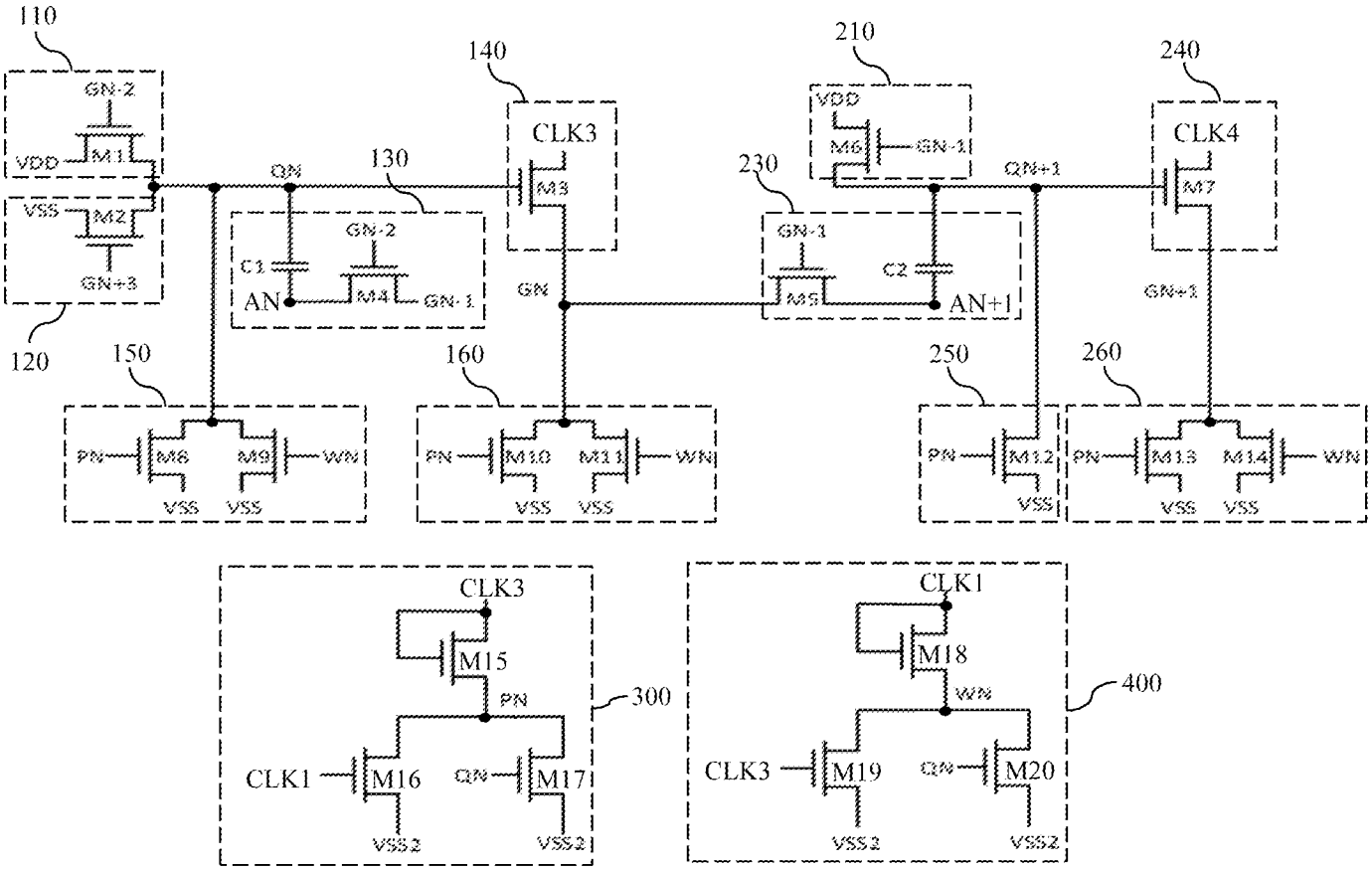
FIG. 3 illustrates a circuit diagram of a single-stage gate driving circuit according to some embodiments of the present invention.

FIG. 3 illustrates a circuit diagram of a single-stage gate driving circuit according to some embodiments of the present invention. For example, the single-stage gate driving circuit as shown in FIG. 3 may be the 3rd-stage of gate driving circuit 30 outputting the gate driving signals G5 and G6, then the term "N" as shown in FIG. 3 is identical to 5.

The single-stage gate driving circuit as shown in FIG. 3 includes a first pre-charge circuit 110, a discharge circuit 120, a first bootstrapping circuit 130, a first output control circuit 140, a first anti-noise circuit 150, a second anti-noise circuit 160, a second pre-charge circuit 210, a second bootstrapping circuit 230, a second output control circuit 240, a second anti-noise circuit 260, a third anti-noise circuit 250, a first negative bias compensation circuit 300, and a second negative bias compensation circuit 400.

The first pre-charge circuit 110 includes a first transistor M1. The first transistor M1 has a first terminal, a second terminal and a control terminal. The discharge circuit 120 includes a second transistor M2. The second transistor M2 has a first terminal, a second terminal and a control terminal. The first output control circuit 140 includes a third transistor M3. The third transistor M3 has a first terminal, a second terminal and a control terminal. The first bootstrapping circuit 130 is composed of a first bootstrapping capacitor C1 and a fourth transistor M4. The fourth transistor M4 has a first terminal, a second terminal and a control terminal.

With regard to the first bootstrapping circuit 130, a first terminal of the first bootstrapping capacitor C1 is connected to a node QN, and a second terminal of the first bootstrapping capacitor C1 is connected to the first terminal of the fourth transistor M4 through a node AN, and the control terminal of the fourth transistor M4 receives the gate driving signal GN−2, and the second terminal of the fourth transistor M4 receives the gate driving signal GN−1.

With regard to the first pre-charge circuit 110, the first terminal of the first transistor M1 is connected to the first terminal of the first bootstrapping capacitor C1 through the node QN (i.e., the first pre-charge circuit 110 is connected to the first bootstrapping circuit 130), and the control terminal of the first transistor M1 receives the gate driving signal GN−3, and the second terminal of the first transistor M1 receives the high system voltage VDD. In some embodiments of the present invention, the high system voltage VDD is, for example, 18 volt (V), but the present invention is not limited thereto.

With regard to the first output control circuit 140, the first terminal of the third transistor M3 receives the clock signal CLK3, and the control terminal of the third transistor M3 is connected to the first terminal of the first bootstrapping capacitor C1 and the first terminal of the first transistor M1 through the node QN (i.e., the first output control circuit 140 is connected to the first pre-charge circuit 110 and the first bootstrapping circuit 130). The third transistor M3 generates the gate driving signal GN at the second terminal of the third transistor M3 according to the clock signal CLK3 received by the first terminal of the third transistor M3 and a voltage signal at the node QN connected to the control terminal of the third transistor M3. Specifically, the first output control circuit 140 outputs the gate driving signal GN through the second terminal of the third transistor M3.

With regard to the discharge circuit 120, the first terminal of the second transistor M2 is connected to the first terminal of the first transistor M1, the first terminal of the first bootstrapping capacitor C1, and the control terminal of the third transistor M3 through the node QN (i.e., the discharge circuit 120 is connected to the first pre-charge circuit 110, the first bootstrapping circuit 130 and the first output control circuit 140), and the control terminal of the second transistor M2 receives the gate driving signal GN+3, and the second terminal of the second transistor M2 receives a first low system voltage VSS. In some embodiments of the present invention, the first low system voltage VSS is, for example, −6V, but the present invention is not limited thereto.

The second bootstrapping circuit 230 is composed of a second bootstrapping capacitor C2 and a fifth transistor M5. The fifth transistor M5 has a first terminal, a second terminal and a control terminal. The second pre-charge circuit 210 includes a sixth transistor M6. The sixth transistor M6 has a first terminal, a second terminal and a control terminal. The second output control circuit 240 includes a seventh transistor M7. The seventh transistor M7 has a first terminal, a second terminal and a control terminal.

With regard to the second bootstrapping circuit 230, a first terminal of the second bootstrapping capacitor C2 is connected to a node QN+1, and a second terminal of the second bootstrapping capacitor C2 is connected to the first terminal of the fifth transistor M5 through a node AN+1, and the control terminal of the fifth transistor M5 receives the gate driving signal GN−1, and the second terminal of the fifth transistor M5 is connected to the second terminal of the third transistor M3 so as to receive the gate driving signal GN (i.e., the second bootstrapping circuit 230 is connected to the first output control circuit 140).

With regard to the second pre-charge circuit 210, the first terminal of the sixth transistor M6 is connected to the first terminal of the second bootstrapping capacitor C2 through the node QN+1 (i.e., the second pre-charge circuit 210 is connected to the second bootstrapping circuit 230), and the control terminal of the sixth transistor M6 receives the gate driving signal GN−1, and the second terminal of the sixth transistor M6 receives the high system voltage VDD.

With regard to the second output control circuit 240, the first terminal of the seventh transistor M7 receives the clock signal CLK4, and the control terminal of the seventh transistor M7 is connected to the first terminal of the second bootstrapping capacitor C2 and the first terminal of the sixth transistor M6 through the node QN+1 (i.e., the second output control circuit 240 is connected to the second pre-charge circuit 210 and the second bootstrapping circuit 230). The seventh transistor M7 generates the gate driving signal GN+1 at the second terminal of the seventh transistor M7 according to the clock signal CLK4 received by the first terminal of the seventh transistor M7 and a voltage signal at the node QN+1 connected to the control terminal of the seventh transistor M7. Specifically, the second output control circuit 240 outputs the gate driving signal GN+1 through the second terminal of the seventh transistor M7.

The first anti-noise circuit 150 includes an eighth transistor M8 and a ninth transistor M9. The eighth transistor M8 has a first terminal, a second terminal and a control terminal. The ninth transistor M9 has a first terminal, a second terminal and a control terminal. The first terminal of the eighth transistor M8 and the first terminal of the ninth transistor M9 are connected to the first terminal of the first transistor M1, the first terminal of the second transistor M2, the first terminal of the first bootstrapping capacitor C1, and the control terminal of the third transistor M3 (i.e., the first anti-noise circuit 150 is connected to the first pre-charge circuit 110, the discharge circuit 120, the first bootstrapping circuit 130 and the first output control circuit 140). The second terminal of the eighth transistor M8 and the second terminal of the ninth transistor M9 receive the first low system voltage VSS. The control terminal of the eighth transistor M8 is connected to a node PN. The control terminal of the ninth transistor M9 is connected to a node WN.

The second anti-noise circuit 160 includes a tenth transistor M10 and an eleventh transistor M11. The tenth transistor M10 has a first terminal, a second terminal and a control terminal. The eleventh transistor M11 has a first terminal, a second terminal and a control terminal. The first terminal of the tenth transistor M10 and the first terminal of the eleventh transistor M11 are connected to the second terminal of the third transistor M3 (i.e., the second anti-noise circuit 160 is connected to the first output control circuit 140). The second terminal of the tenth transistor M10 and the second terminal of the eleventh transistor M11 receive the first low system voltage VSS. The control terminal of the tenth transistor M10 is connected to the node PN. The control terminal of the eleventh transistor M11 is connected to the node WN.

The third anti-noise circuit 250 includes a twelfth transistor M12. The twelfth transistor M12 has a first terminal, a second terminal and a control terminal. The first terminal of the twelfth transistor M12 is connected to the first terminal of the sixth transistor M6, the first terminal of the second bootstrapping capacitor C2, and the control terminal of the seventh transistor M7 through the node QN+1 (i.e., the third anti-noise circuit 250 is connected to the second pre-charge circuit 210, the second bootstrapping circuit 230, and the second output control circuit 240). The second terminal of the twelfth transistor M12 receives the first low system voltage VSS. The control terminal of the twelfth transistor M12 is connected to the node PN.

The fourth anti-noise circuit 260 includes a thirteenth transistor M13 and a fourteenth transistor M14. The thirteenth transistor M13 has a first terminal, a second terminal and a control terminal. The fourteenth transistor M14 has a first terminal, a second terminal and a control terminal. The first terminal of the thirteenth transistor M13 and the first terminal of the fourteenth transistor M14 are connected to the second terminal of the seventh transistor M7 (i.e., the fourth anti-noise circuit 260 is connected to the second output control circuit 240). The second terminal of the thirteenth transistor M13 and the second terminal of the fourteenth transistor M14 receive the first low system voltage VSS. The control terminal of the thirteenth transistor M13 is connected to the node PN. The control terminal of the fourteenth transistor M14 is connected to the node WN.

Specifically, the single-stage gate driving circuit as shown in FIG. 3 outputs the gate driving signal GN through the second terminal of the third transistor M3 of the first output control circuit 140 and outputs the gate driving signal GN+1 through the second terminal of the seventh transistor M7 of the second output control circuit 240. In other words, the single-stage gate driving circuit of the present invention outputs plural gate driving signals.

The first negative bias compensation circuit 300 includes a fifteenth transistor M15, a sixteenth transistor M16, and a seventeenth transistor M17. The fifteenth transistor M15 has a first terminal, a second terminal and a control terminal. The sixteenth transistor M16 has a first terminal, a second terminal and a control terminal. The seventeenth transistor M17 has a first terminal, a second terminal and a control terminal. The first terminal and the control terminal of the fifteenth transistor M15 receive the clock signal CLK3. The second terminal of the fifteenth transistor M15 is connected to the first terminal of the sixteenth transistor M16 and the first terminal of the seventeenth transistor M17. The second terminal of the fifteenth transistor M15, the first terminal of the sixteenth transistor M16, and the first terminal of the seventeenth transistor M17 are connected to the node PN (i.e., the first negative bias compensation circuit 300 is connected to the first anti-noise circuit 150, the second anti-noise circuit 160, the third anti-noise circuit 250, and the fourth anti-noise circuit 260). The control terminal of the sixteenth transistor M16 receives the clock signal CLK1. The control terminal of the seventeenth transistor M17 is connected to the node QN. The second terminal of the sixteenth transistor M16 and the second terminal of the seventeenth transistor M17 receive a second low system voltage VSS2.

In some embodiments of the present invention, the second low system voltage VSS2 is less than the first low system voltage VSS. For example, the second low system voltage VSS2 is −10V, and the first low system voltage VSS is −6V, but the present invention is not limited thereto.

The second negative bias compensation circuit 400 includes an eighteenth transistor M18, a nineteenth transistor M19, and a twentieth transistor M20. The eighteenth transistor M18 has a first terminal, a second terminal and a control terminal. The nineteenth transistor M19 has a first terminal, a second terminal and a control terminal. The twentieth transistor M20 has a first terminal, a second terminal and a control terminal. The first terminal and the control terminal of the eighteenth transistor M18 receive the clock signal CLK1. The second terminal of the eighteenth transistor M18 is connected to the first terminal of the nineteenth transistor M19 and the first terminal of the twentieth transistor M20. The second terminal of the eighteenth transistor M18, the first terminal of the nineteenth transistor M19, and the first terminal of the twentieth transistor M20 are connected to the node WN (i.e., the second negative bias compensation circuit 400 is connected to the first anti-noise circuit 150, the second anti-noise circuit 160, and the fourth anti-noise circuit 260). The control terminal of the nineteenth transistor M19 receives the clock signal CLK3. The control terminal of the twentieth transistor M20 is connected to the node QN. The second terminal of the nineteenth transistor M19 and the second terminal of the twentieth transistor M20 receive the second low system voltage VSS2.

Figure 4:
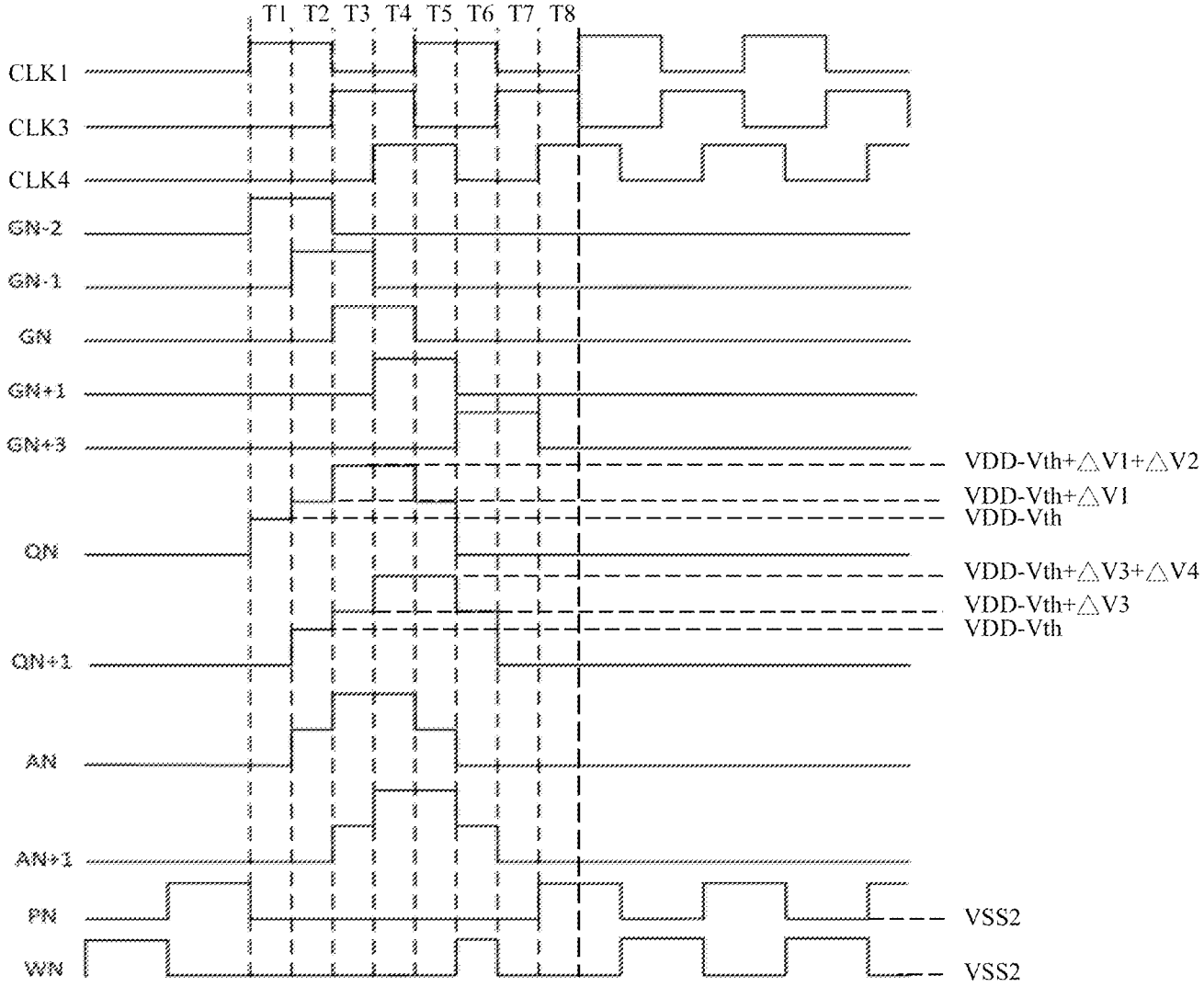
FIG. 4 illustrates a timing chart of the single-stage gate driving circuit according to some embodiments of the present invention.

The aforementioned content has described the detailed component connection relationship of the single-stage gate driving circuit. The following content will explain the operation of the single-stage gate driving circuit of the present invention such that the improvement of driving capability could be achieved. FIG. 4 illustrates a timing chart of the single-stage gate driving circuit according to some embodiments of the present invention. Referring to FIG. 3 and FIG. 4.

First, during a first duration T1, the control terminal of the first transistor M1 of the first pre-charge circuit 110 receives the gate driving signal GN−2 with a high voltage level so as to turn on the first transistor M1, such that a first-stage voltage rise occurs at the node QN connected to the first terminal of the first transistor M1. Specifically, the node QN is precharged to a first voltage. The said first voltage is identical to the high voltage level received by the second terminal of the first transistor M1 minus a threshold voltage Vth of the first transistor M1, i.e., VDD-Vth. The said first voltage of the node QN connected to the control terminal of the third transistor M3 also causes the third transistor M3 of the first output control circuit 140 to be turned on.

On the other hand, during the first duration T1, the control terminal of the fourth transistor M4 of the first bootstrapping circuit 130 receives the gate driving signal GN−2 with the high voltage level so as to turn on the fourth transistor M4, such that the voltage level of the node AN connected to the first terminal of the fourth transistor M4 is substantially identical to the present voltage level (i.e., the low voltage level) of the gate driving signal GN−1 received by the second terminal of the fourth transistor M4. Therefore, the voltage difference between the node QN and the node AN causes the first bootstrapping capacitor C1 has a capacitive potential for the generation of the subsequent capacitive coupling operation.

In addition, during the first duration T1, the eighth transistor M8 of the first anti-noise circuit 150 is turned off, and the sixteenth transistor M16 and the seventeenth transistor M17 of the first negative bias compensation circuit 300 are turned on, and therefore the voltage level of the node PN connected to the control terminal of the eighth transistor M8 is pulled down to the second low system voltage VSS2 received by the second terminal of the sixteenth transistor M16 and the second terminal of the seventeenth transistor M17, such that a gate-to-source voltage (Vgs) of the eighth transistor M8 is identical to the second low system voltage VSS2 minus the first low system voltage VSS (e.g., (−10V)−(−6V)=(−4V)). Thus, the lower cross-voltage Vgs of the turned off eighth transistor M8 causes the eighth transistor M8 to be operated in the lower current leakage state. And therefore, during the first duration T1, the current leakage of the eighth transistor M8 could be avoided and the voltage level of the node QN connected to the first terminal of the eighth transistor M8 could be maintained at the first voltage.

In addition, during the first duration T1, the ninth transistor M9 of the first anti-noise circuit 150 is turned off, and the eighteenth transistor M18 and the twentieth transistor M20 of the second negative bias compensation circuit 400 are turned on, and therefore the voltage level of the node WN connected to the control terminal of the ninth transistor M9 is pulled down to the second low system voltage VSS2 received by the second terminal of the twentieth transistor M20, such that a gate-to-source voltage (Vgs) of the ninth transistor M9 is identical to the second low system voltage VSS2 minus the first low system voltage VSS (e.g., (−10V)−(−6V)=(−4V)). Thus, the lower cross-voltage Vgs of the turned off ninth transistor M9 causes the ninth transistor M9 to be operated in the lower current leakage state. And therefore, during the first duration T1, the current leakage of the ninth transistor M9 could be avoided and the voltage level of the node QN connected to the first terminal of the ninth transistor M9 could be maintained at the first voltage.

Then, during a second duration T2, the control terminal of the fourth transistor M4 of the first bootstrapping circuit 130 receives the gate driving signal GN−2 with the high voltage level so as to continuously turn on the fourth transistor M4. In the meantime, the gate driving signal GN−1 received by the second terminal of the fourth transistor M4 is pulled up from the low voltage level to the high voltage level so as to charge the node AN connected to the first terminal of the fourth transistor M4, such that a voltage rise occurs at the node AN. Thus, a second-stage voltage rise occurs at the node QN by utilizing the capacitive coupling of the first bootstrapping capacitor C1. Specifically, the node QN is boosted from the first voltage to a second voltage (i.e., VDD−Vth+ΔV1).

In addition, during the second duration T2, the eighth transistor M8 of the first anti-noise circuit 150 is turned off, and the sixteenth transistor M16 and the seventeenth transistor M17 of the first negative bias compensation circuit 300 are turned on, and therefore the gate-to-source voltage (Vgs) of the eighth transistor M8 is still identical to the second low system voltage VSS2 minus the first low system voltage VSS. Thus, the lower cross-voltage Vgs of the turned off eighth transistor M8 causes the eighth transistor M8 to be still operated in the lower current leakage state. And therefore, during the second duration T2, the current leakage of the eighth transistor M8 could be avoided and the voltage level of the node QN connected to the first terminal of the eighth transistor M8 could be maintained at the second voltage.

In addition, during the second duration T2, the ninth transistor M9 of the first anti-noise circuit 150 is turned off, and the eighteenth transistor M18 and the twentieth transistor M20 of the second negative bias compensation circuit 400 are turned on, and therefore the gate-to-source voltage (Vgs) of the ninth transistor M9 is still identical to the second low system voltage VSS2 minus the first low system voltage VSS. Thus, the lower cross-voltage Vgs of the turned off ninth transistor M9 causes the ninth transistor M9 to be still operated in the lower current leakage state. And therefore, during the second duration T2, the current leakage of the ninth transistor M9 could be avoided and the voltage level of the node QN connected to the first terminal of the ninth transistor M9 could be maintained at the second voltage.

In addition, during the second duration T2, the control terminal of the sixth transistor M6 of the second pre-charge circuit 210 receives the gate driving signal GN−1 with a high voltage level so as to turn on the sixth transistor M6, such that a first-stage voltage rise occurs at the node QN+1 connected to the first terminal of the sixth transistor M6. Specifically, the node QN+1 is precharged to a fourth voltage. The said fourth voltage is identical to the high system voltage VDD received by the second terminal of the sixth transistor M6 minus a threshold voltage Vth of the sixth transistor M6, i.e., VDD-Vth. The said fourth voltage of the node QN+1 connected to the control terminal of the seventh transistor M7 also causes the seventh transistor M7 of the second output control circuit 240 to be turned on.

On the other hand, during the second duration T2, the control terminal of the fifth transistor M5 of the second bootstrapping circuit 230 receives the gate driving signal GN−1 with the high voltage level so as to turn on the fifth transistor M5, such that the voltage level of the node AN+1 connected to the first terminal of the fifth transistor M5 is substantially identical to the present voltage level (i.e., the low voltage level) of the gate driving signal GN received by the second terminal of the fifth transistor M5. Therefore, the voltage difference between the node QN+1 and the node AN+1 causes the second bootstrapping capacitor C2 has a capacitive potential for the generation of the subsequent capacitive coupling operation.

In addition, during the second duration T2, the twelfth transistor M12 of the third anti-noise circuit 250 is turned off, and the sixteenth transistor M16 and the seventeenth transistor M17 of the first negative bias compensation circuit 300 are turned on, and therefore the voltage level of the node PN connected to the control terminal of the twelfth transistor M12 is pulled down to the second low system voltage VSS2 received by the second terminal of the sixteenth transistor M16 and the second terminal of the seventeenth transistor M17, such that a gate-to-source voltage (Vgs) of the twelfth transistor M12 is identical to the second low system voltage VSS2 minus the first low system voltage VSS (e.g., (−10V)−(−6V)=(−4V)). Thus, the lower cross-voltage Vgs of the turned off twelfth transistor M12 causes the twelfth transistor M12 to be operated in the lower current leakage state. And therefore, during the second duration T2, the current leakage of the twelfth transistor M12 could be avoided and the voltage level of the node QN+1 connected to the first terminal of the twelfth transistor M12 could be maintained at the fourth voltage.

Then, during a third duration T3, the gate driving signal GN−2 received by the control terminal of the first transistor M1 of the first pre-charge circuit 110 is pulled down from the high voltage level to the low voltage level so as to turn off the first transistor M1, meanwhile, the first terminal of the third transistor M3 of the first output control circuit 140 receives the clock signal CLK3 with the high voltage level. Thus, a third-stage voltage rise occurs at the node QN connected to the control terminal of the third transistor M3 by utilizing the capacitive coupling of the parasitic capacitor (e.g., a gate-to-drain capacitor Cgd) of the third transistor M3. Specifically, the node QN is boosted from the second voltage to a third voltage (i.e., VDD-Vth+ΔV1+ΔV2).

On the other hand, during the third duration T3, by utilizing the capacitive coupling of the parasitic capacitor (e.g., a gate-to-source capacitor Cgs) of the third transistor M3, the gate driving signal GN outputted by the second terminal of the third transistor M3 is pulled up to a voltage level which is approximately identical to the voltage level of the node QN connected to the control terminal of the third transistor M3. In other words, during the third duration T3, the first output control circuit 140 pulls up the gate driving signal GN outputted by the second terminal of the third transistor M3 according to the third voltage of the first terminal of the first bootstrapping capacitor C1 and the clock signal CLK3.

In addition, during the third duration T3, the eighth transistor M8 of the first anti-noise circuit 150 is turned off, and the fifteenth transistor M15, the sixteenth transistor M16 and the seventeenth transistor M17 of the first negative bias compensation circuit 300 are turned on, and therefore the gate-to-source voltage (Vgs) of the eighth transistor M8 is still identical to the second low system voltage VSS2 minus the first low system voltage VSS. Thus, the lower cross-voltage Vgs of the turned off eighth transistor M8 causes the eighth transistor M8 to be still operated in the lower current leakage state. And therefore, during the third duration T3, the current leakage of the eighth transistor M8 could be avoided and the voltage level of the node QN connected to the first terminal of the eighth transistor M8 could be maintained at the third voltage.

In addition, during the third duration T3, the ninth transistor M9 of the first anti-noise circuit 150 is turned off, and the nineteenth transistor M19 and the twentieth transistor M20 of the second negative bias compensation circuit 400 are turned on, and therefore the gate-to-source voltage (Vgs) of the ninth transistor M9 is still identical to the second low system voltage VSS2 minus the first low system voltage VSS. Thus, the lower cross-voltage Vgs of the turned off ninth transistor M9 causes the ninth transistor M9 to be still operated in the lower current leakage state. And therefore, during the third duration T3, the current leakage of the ninth transistor M9 could be avoided and the voltage level of the node QN connected to the first terminal of the ninth transistor M9 could be maintained at the third voltage.

In addition, during the third duration T3, the tenth transistor M10 of the second anti-noise circuit 160 is turned off, and the fifteenth transistor M15, the sixteenth transistor M16 and the seventeenth transistor M17 of the first negative bias compensation circuit 300 are turned on, and therefore the voltage level of the control terminal of the tenth transistor M10 is pulled down to the second low system voltage VSS2 received by the second terminal of the sixteenth transistor M16 and the second terminal of the seventeenth transistor M17, such that a gate-to-source voltage (Vgs) of the tenth transistor M10 is identical to the second low system voltage VSS2 minus the first low system voltage VSS (e.g., (−10V)−(−6V)=(−4V)). Thus, the lower cross-voltage Vgs of the turned off tenth transistor M10 causes the tenth transistor M10 to be operated in the lower current leakage state. And therefore, during the third duration T3, the current leakage of the tenth transistor M10 could be avoided and the voltage level of the gate driving signal GN received by the first terminal of the tenth transistor M10 could be maintained at the third voltage.

In addition, during the third duration T3, the eleventh transistor M11 of the second anti-noise circuit 160 is turned off, and the nineteenth transistor M19 and the twentieth transistor M20 of the second negative bias compensation circuit 400 are turned on, and therefore the voltage level of the control terminal of the eleventh transistor M11 is pulled down to the second low system voltage VSS2 received by the second terminal of the nineteenth transistor M19 and the second terminal of the twentieth transistor M20, such that a gate-to-source voltage (Vgs) of the eleventh transistor M11 is identical to the second low system voltage VSS2 minus the first low system voltage VSS (e.g., (−10V)−(−6V)=(−4V)). Thus, the lower cross-voltage Vgs of the turned off eleventh transistor M11 causes the eleventh transistor M11 to be operated in the lower current leakage state. And therefore, during the third duration T3, the current leakage of the eleventh transistor M11 could be avoided and the voltage level of the gate driving signal GN received by the first terminal of the eleventh transistor M11 could be maintained at the third voltage.

In addition, during the third duration T3, the control terminal of the fifth transistor M5 of the second bootstrapping circuit 230 receives the gate driving signal GN−1 with the high voltage level so as to continuously turn on the fifth transistor M5. In the meantime, the gate driving signal GN received by the second terminal of the fifth transistor M5 is pulled up from the low voltage level to the high voltage level so as to charge the node AN+1 connected to the first terminal of the fifth transistor M5, such that a voltage rise occurs at the node AN+1. Thus, a second-stage voltage rise occurs at the node QN+1 by utilizing the capacitive coupling of the second bootstrapping capacitor C2. Specifically, the node QN+1 is boosted from the fourth voltage to a fifth voltage (i.e., VDD−Vth+ΔV3).

In addition, during the third duration T3, the twelfth transistor M12 of the third anti-noise circuit 250 is turned off, and the fifteenth transistor M15, the sixteenth transistor M16 and the seventeenth transistor M17 of the first negative bias compensation circuit 300 are turned on, and therefore the gate-to-source voltage (Vgs) of the twelfth transistor M12 M8 is still identical to the second low system voltage VSS2 minus the first low system voltage VSS. Thus, the lower cross-voltage Vgs of the turned off twelfth transistor M12 causes the twelfth transistor M12 to be still operated in the lower current leakage state. And therefore, during the third duration T3, the current leakage of the twelfth transistor M12 could be avoided and the voltage level of the node QN+1 connected to the first terminal of the twelfth transistor M12 could be maintained at the fifth voltage.

Then, during a fourth duration T4, the gate driving signal GN−1 received by the control terminal of the fifth transistor M5 of the second pre-charge circuit 210 is pulled down from the high voltage level to the low voltage level so as to turn off the fifth transistor M5, meanwhile, the first terminal of the seventh transistor M7 of the second output control circuit 240 receives the clock signal CLK4 with the high voltage level. Thus, a third-stage voltage rise occurs at the node QN+1 connected to the control terminal of the seventh transistor M7 by utilizing the capacitive coupling of the parasitic capacitor (e.g., a gate-to-drain capacitor Cgd) of the seventh transistor M7. Specifically, the node QN+1 is boosted from the fifth voltage to a sixth voltage (i.e., VDD−Vth+ΔV3+ΔV4).

On the other hand, during the fourth duration T4, by utilizing the capacitive coupling of the parasitic capacitor (e.g., a gate-to-source capacitor Cgs) of the seventh transistor M7, the gate driving signal GN+1 outputted by the second terminal of the seventh transistor M7 is pulled up to a voltage level which is approximately identical to the voltage level of the node QN+1 connected to the control terminal of the seventh transistor M7. In other words, during the fourth duration T4, the second output control circuit 240 pulls up the gate driving signal GN+1 outputted by the second terminal of the seventh transistor M7 according to the sixth voltage of the first terminal of the second bootstrapping capacitor C2 and the clock signal CLK4.

In addition, during the fourth duration T4, the twelfth transistor M12 of the third anti-noise circuit 250 is turned off, and the fifteenth transistor M15, the sixteenth transistor M16 and the seventeenth transistor M17 of the first negative bias compensation circuit 300 are turned on, and therefore the gate-to-source voltage (Vgs) of the twelfth transistor M12 is still identical to the second low system voltage VSS2 minus the first low system voltage VSS. Thus, the lower cross-voltage Vgs of the turned off twelfth transistor M12 causes the twelfth transistor M12 to be still operated in the lower current leakage state. And therefore, during the fourth duration T4, the current leakage of the twelfth transistor M12 could be avoided and the voltage level of the node QN+1 connected to the first terminal of the twelfth transistor M12 could be maintained at the sixth voltage.

In addition, during the fourth duration T4, the thirteenth transistor M13 of the fourth anti-noise circuit 260 is turned off, and the fifteenth transistor M15, the sixteenth transistor M16 and the seventeenth transistor M17 of the first negative bias compensation circuit 300 are turned on, and therefore the voltage level of the control terminal of the thirteenth transistor M13 is pulled down to the second low system voltage VSS2 received by the second terminal of the sixteenth transistor M16 and the second terminal of the seventeenth transistor M17, such that a gate-to-source voltage (Vgs) of the thirteenth transistor M13 is identical to the second low system voltage VSS2 minus the first low system voltage VSS (e.g., (−10V)−(−6V)=(−4V)). Thus, the lower cross-voltage Vgs of the turned off thirteenth transistor M13 causes the thirteenth transistor M13 to be operated in the lower current leakage state. And therefore, during the fourth duration T4, the current leakage of the thirteenth transistor M13 could be avoided and the voltage level of the gate driving signal GN+1 received by the first terminal of the thirteenth transistor M13 could be maintained at the sixth voltage.

In addition, during the fourth duration T4, the fourteenth transistor M14 of the fourth anti-noise circuit 260 is turned off, and the nineteenth transistor M19 and the twentieth transistor M20 of the second negative bias compensation circuit 400 are turned on, and therefore the voltage level of the control terminal of the fourteenth transistor M14 is pulled down to the second low system voltage VSS2 received by the second terminal of the nineteenth transistor M19 and the second terminal of the twentieth transistor M20, such that a gate-to-source voltage (Vgs) of the fourteenth transistor M14 is identical to the second low system voltage VSS2 minus the first low system voltage VSS (e.g., (−10V)−(−6V)=(−4V)). Thus, the lower cross-voltage Vgs of the turned off fourteenth transistor M14 causes the fourteenth transistor M14 to be operated in the lower current leakage state. And therefore, during the fourth duration T4, the current leakage of the fourteenth transistor M14 could be avoided and the voltage level of the gate driving signal GN+1 received by the first terminal of the fourteenth transistor M14 could be maintained at the sixth voltage.

It is noted that when the operation reaches the third duration T3, the voltage level of the node QN is highest. As shown in the timing chart of FIG. 4, under the operational mode, the first terminal of the first bootstrapping capacitor C1 is pulled up to the first voltage VDD−Vth during the first duration T1, and then the first terminal of the first bootstrapping capacitor C1 is pulled up from the first voltage VDD−Vth to the second voltage VDD−Vth+ΔV1 during the second duration T2, and then the first terminal of the first bootstrapping capacitor C1 is pulled up from the second voltage VDD−Vth+ΔV1 to the third voltage VDD−Vth+ΔV1+ΔV2 during the third duration T3. The multiple stages of voltage rise are respectively occurred at the first terminal of the first bootstrapping capacitor C1 during the different durations. By the means of charging and then capacitive coupling, the node QN of the single-stage gate driving circuit could be pulled up to a higher voltage level, such that the voltage level of the gate driving signal GN of the single-stage gate driving circuit is also pulled up to another higher voltage level, thereby greatly improving the current driving capability of the single-stage gate driving circuit.

It is noted that when the operation reaches the fourth duration T4, the voltage level of the node QN+1 is highest. As shown in the timing chart of FIG. 4, under the operational mode, the first terminal of the second bootstrapping capacitor C2 is pulled up to the fourth voltage VDD−Vth during the second duration T2, and then the first terminal of the second bootstrapping capacitor C2 is pulled up from the fourth voltage VDD−Vth to the fifth voltage VDD−Vth+ΔV3 during the third duration T3, and then the first terminal of the second bootstrapping capacitor C2 is pulled up from the fifth voltage VDD−Vth+ΔV3 to the sixth voltage VDD−Vth+ΔV3+ΔV4 during the fourth duration T4. The multiple stages of voltage rise are respectively occurred at the first terminal of the second bootstrapping capacitor C2 during the different durations. By the means of charging and then capacitive coupling, the node QN+1 of the single-stage gate driving circuit could be pulled up to a higher voltage level, such that the voltage level of the gate driving signal GN+1 of the single-stage gate driving circuit is also pulled up to another higher voltage level, thereby greatly improving the current driving capability of the single-stage gate driving circuit.

In addition, because the multiple stages of voltage rise are respectively occurred at the first terminal of the first bootstrapping capacitor C1 and the first terminal of the second bootstrapping capacitor C2 during the different durations, the node QN and the node QN+1 of the single-stage gate driving circuit could be quickly pulled up to a specified voltage level even in a low temperature environment (e.g., −40° C.), thereby solving the problem of greatly reduced current driving capability caused by the low carrier mobility of a-Si at the low temperature, such that the circuit of the present invention is more suitable for the display devices with high-speed requirements. In addition, because the multiple stages of voltage rise are respectively occurred at the first terminal of the first bootstrapping capacitor C1 and the first terminal of the second bootstrapping capacitor C2 during the different durations, the electrical degradation of the circuit caused by high temperature environment (e.g., 85° C. or 90° C.) could be compensated, and thus the circuit of the present invention can be more reliable in extreme temperature environments and can pass the stress test at the high temperature environment (e.g., 85° C.).

Specifically, under the operational mode (i.e., from the first duration T1 to the fourth duration T4) of the single-stage gate driving circuit, the first anti-noise circuit 150, the second anti-noise circuit 160, the third anti-noise circuit 250, the fourth anti-noise circuit 260, the first negative bias compensation circuit 300, and/or the second negative bias compensation circuit 400 cause the current leakage could be avoided and the voltage level of the node QN, the voltage level of the node QN+1, the voltage level of the gate driving signal GN and/or the voltage level of the gate driving signal GN+1 could be maintained. In addition, the lower cross-voltage Vgs of the turned off eighth transistor M8, the lower cross-voltage Vgs of the turned off ninth transistor M9 and/or the lower cross-voltage Vgs of the turned off twelfth transistor M12 could extend the life of the single-stage gate driving circuit at the high temperature environment. Therefore, the single-stage gate driving circuit of the present invention can be more reliable in extreme temperature environments and can pass the stress test at the high temperature environment.

It is noted that the first bootstrapping capacitor C1 of the present invention is merely connected to six transistors (i.e., the first transistor M1, the second transistor M2, the third transistor M3, the fourth transistor M4, the eighth transistor M8 and the ninth transistor M9), and thus the voltage coupling efficiency of the first bootstrapping capacitor C1 could be greatly improved. And, the second bootstrapping capacitor C2 of the present invention is merely connected to four transistors (i.e., the fifth transistor M5, the sixth transistor M6, the seventh transistor M7 and the twelfth transistor M12), and thus the voltage coupling efficiency of the second bootstrapping capacitor C2 could be greatly improved. In detail, traditionally, the second terminal of the bootstrapping capacitor of the conventional gate driving circuit usually needs to be connected to plenty of transistors, and one of the said plenty of transistors is used for first pulling down the voltage level of the second terminal of the bootstrapping capacitor to the low voltage level, and the others of the said plenty of transistors are used for subsequently charging the bootstrapping capacitor so as to pull up the voltage level of the second terminal of the bootstrapping capacitor. However, when the second terminal of the bootstrapping capacitor of the conventional gate driving circuit is connected to too many transistors, the voltage coupling efficiency of the bootstrapping capacitor of the conventional gate driving circuit will be significantly reduced. In contrast, the second terminal of the first bootstrapping capacitor C1 is merely connected to one transistor (i.e., the fourth transistor M4) and the second terminal of the second bootstrapping capacitor C2 is also merely connected to one transistor (i.e., the fifth transistor M5), and therefore the voltage coupling efficiency of the first bootstrapping capacitor C1 and the second bootstrapping capacitor C2 of the present invention could be effectively improved.

On the other hand, the design of the single-stage gate driving circuit of the present invention is more simplified. For example, as described above, the first bootstrapping capacitor C1 of the present invention is merely connected to six transistors and second bootstrapping capacitor C1 of the present invention is merely connected to four transistors, thereby reducing the number of the components of the single-stage gate driving circuit of the present invention. For example, the single-stage gate driving circuit as shown in FIG. 3 realize a structure of single-stage gate driving circuit with multiple outputs (the gate driving signal GN and the gate driving signal GN+1), thereby reducing the number of the components of the single-stage gate driving circuit of the present invention. For example, the first anti-noise circuit 150, the second anti-noise circuit 160, the third anti-noise circuit 250 and the fourth anti-noise circuit 260 of the single-stage gate driving circuit as shown in FIG. 3 share the first negative bias compensation circuit 300 and the second negative bias compensation circuit 400, thereby reducing the number of the components of the single-stage gate driving circuit of the present invention. Therefore, by reducing the number of the components of the single-stage gate driving circuit of the present invention, the layout area could be saved and the production costs could be reduce, such that the present invention could meet the requirement of the medium-size GOA circuit and the single-stage gate driving circuit of the present invention could be more suitable for the display devices with high resolution and/or narrow bezels, such as the fingerprint recognition display devices, the pixel array display devices, the organic light-emitting diode (OLED) display devices, the micro-LED displays devices, the mini-LED display devices, etc.

It is worth mentioning that the single-stage gate driving circuit as shown in FIG. 3 realizes a structure of the single-stage gate driving circuit with multiple outputs (the gate driving signal GN and the gate driving signal GN+1), but the present invention is not limited thereto. For example, the second terminal of the seventh transistor M7 of the second output control circuit 240 could be further backwardly connected to one or more circuit groups including a bootstrap circuit, a pre-charge circuit and/or an output control circuit, such that the single-stage gate driving circuit has, for example, a structure of the single-stage gate driving circuit with four outputs or eight outputs.

Then, during a fifth duration T5, the clock signal CLK3 received by the first terminal of the third transistor M3 of the first output control circuit 140 is pulled down from the high voltage level to the low voltage level. Thus, the node QN connected to the control terminal of the third transistor M3 is pulled down to the second voltage (i.e., VDD−Vth+ΔV1) by utilizing the capacitive coupling of the parasitic capacitor (e.g., a gate-to-drain capacitor Cgd) of the third transistor M3.

On the other hand, during the fifth duration T5, the clock signal CLK3 is pulled down from the high voltage level to the low voltage level, such that the gate driving signal GN received by the second terminal of the turned on third transistor M3 is discharged. In the meantime, the clock signal CLK1 received by the first terminal and the control terminal of the eighteenth transistor M18 is pulled up from the low voltage level to the high voltage level, such that the node WN connected to the control terminal of the eleventh transistor M11 is pulled up so as to turn on the eleventh transistor M11. Thus, the gate driving signal GN received by the first terminal of the turned on eleventh transistor M11 is discharged toward the first low system voltage VSS received by the second terminal of the eleventh transistor M11, and therefore the gate driving signal GN is pulled down to the low voltage level, thereby preventing noise generation under the sleep mode (i.e., the fifth duration T5).

In addition, during the fifth duration T5, the eighth transistor M8 of the first anti-noise circuit 150 is turned off, and the fifteenth transistor M15, the sixteenth transistor M16 and the seventeenth transistor M17 of the first negative bias compensation circuit 300 are turned on, and therefore the node PN connected to the control terminal of the eighth transistor M8 is pulled down to the second low system voltage VSS2 received by the second terminal of the sixteenth transistor M16 and the second terminal of the seventeenth transistor M17, such that the gate-to-source voltage (Vgs) of the eighth transistor M8 is identical to the second low system voltage VSS2 minus the first low system voltage VSS (e.g., (−10V)−(−6V)=(−4V)). Accordingly, the cross-voltage Vgs of the eighth transistor M8 causes the negative bias compensation to be occurred on the eighth transistor M8. The electrons trapped by the defects of the insulator layer of the eighth transistor M8 could be effectively eliminated through the negative bias compensation, such that the threshold voltage of the eighth transistor M8 could be restored to the un-degraded threshold voltage.

In addition, during the fifth duration T5, the tenth transistor M10 of the second anti-noise circuit 160 is turned off, and the fifteenth transistor M15, the sixteenth transistor M16 and the seventeenth transistor M17 of the first negative bias compensation circuit 300 are turned on, and therefore the node PN connected to the control terminal of the tenth transistor M10 is pulled down to the second low system voltage VSS2 received by the second terminal of the sixteenth transistor M16 and the second terminal of the seventeenth transistor M17, such that the gate-to-source voltage (Vgs) of the tenth transistor M10 is identical to the second low system voltage VSS2 minus the first low system voltage VSS (e.g., (−10V)−(−6V)=(−4V)). Accordingly, the cross-voltage Vgs of the tenth transistor M10 causes the negative bias compensation to be occurred on the tenth transistor M10. The electrons trapped by the defects of the insulator layer of the tenth transistor M10 could be effectively eliminated through the negative bias compensation, such that the threshold voltage of the tenth transistor M10 could be restored to the un-degraded threshold voltage.

Then, during a sixth duration T6, the control terminal of the second transistor M2 of the discharge circuit 120 receives the gate driving signal GN+3 with the high voltage level so as to turn on the second transistor M2, such that the node QN connected to the first terminal of the turned on second transistor M2 is discharged and pulled down to the first low system voltage VSS received by the second terminal of the second transistor M2, and the first low system voltage VSS of the node QN connected to the control terminal of the third transistor M3 further causes the third transistor M3 to be turned off.

In addition, during the sixth duration T6, the eleventh transistor M11 is continuously turned on, such that the gate driving signal GN received by the first terminal of the turned on eleventh transistor M11 maintain at the first low system voltage VSS received by the second terminal of the eleventh transistor M11, thereby preventing noise generation under the sleep mode (i.e., the sixth duration T6).

In addition, during the sixth duration T6, the tenth transistor M10 of the second anti-noise circuit 160 is turned off, and the fifteenth transistor M15, the sixteenth transistor M16 and the seventeenth transistor M17 of the first negative bias compensation circuit 300 are turned on, and therefore the node PN connected to the control terminal of the tenth transistor M10 is pulled down to the second low system voltage VSS2 received by the second terminal of the sixteenth transistor M16 and the second terminal of the seventeenth transistor M17, such that the gate-to-source voltage (Vgs) of the tenth transistor M10 is identical to the second low system voltage VSS2 minus the first low system voltage VSS (e.g., (−10V)−(−6V)=(−4V)). Accordingly, the cross-voltage Vgs of the tenth transistor M10 causes the negative bias compensation to be occurred on the tenth transistor M10. The electrons trapped by the defects of the insulator layer of the tenth transistor M10 could be effectively eliminated through the negative bias compensation, such that the threshold voltage of the tenth transistor M10 could be restored to the un-degraded threshold voltage.

In addition, during the sixth duration T6, the eighth transistor M8 of the first anti-noise circuit 150 is turned off, and the fifteenth transistor M15, the sixteenth transistor M16 and the seventeenth transistor M17 of the first negative bias compensation circuit 300 are turned on, and therefore the voltage level of the control terminal of the eighth transistor M8 is pulled down to the second low system voltage VSS2 received by the second terminal of the sixteenth transistor M16 and the second terminal of the seventeenth transistor M17, such that the gate-to-source voltage (Vgs) of the eighth transistor M8 is identical to the second low system voltage VSS2 minus the first low system voltage VSS (e.g., (−10V)−(−6V)=(−4V)). Accordingly, the cross-voltage Vgs of the eighth transistor M8 causes the negative bias compensation to be occurred on the eighth transistor M8. The electrons trapped by the defects of the insulator layer of the eighth transistor M8 could be effectively eliminated through the negative bias compensation, such that the threshold voltage of the eighth transistor M8 could be restored to the un-degraded threshold voltage.

Specifically, during the sixth duration T6, the lower cross-voltage Vgs of the turned off eighth transistor M8 could extend the life of the single-stage gate driving circuit at the high temperature environment. Therefore, the single-stage gate driving circuit of the present invention can be more reliable in extreme temperature environments and can pass the stress test at the high temperature environment.

In addition, during the sixth duration T6, the clock signal CLK4 received by the first terminal of the seventh transistor M7 of the second output control circuit 240 is pulled down from the high voltage level to the low voltage level. Thus, the node QN+1 connected to the control terminal of the seventh transistor M7 is pulled down to the fifth voltage (i.e., VDD−Vth+ΔV3) by utilizing the capacitive coupling of the parasitic capacitor (e.g., a gate-to-drain capacitor Cgd) of the seventh transistor M7.

In addition, during the sixth duration T6, the twelfth transistor M12 of the third anti-noise circuit 250 is turned off, and the fifteenth transistor M15, the sixteenth transistor M16 and the seventeenth transistor M17 of the first negative bias compensation circuit 300 are turned on, and therefore the node PN connected to the control terminal of the twelfth transistor M12 is pulled down to the second low system voltage VSS2 received by the second terminal of the sixteenth transistor M16 and the second terminal of the seventeenth transistor M17, such that the gate-to-source voltage (Vgs) of the twelfth transistor M12 is identical to the second low system voltage VSS2 minus the first low system voltage VSS (e.g., (−10V)−(−6V)=(−4V)). Accordingly, the cross-voltage Vgs of the twelfth transistor M12 causes the negative bias compensation to be occurred on the twelfth transistor M12. The electrons trapped by the defects of the insulator layer of the twelfth transistor M12 could be effectively eliminated through the negative bias compensation, such that the threshold voltage of the twelfth transistor M12 could be restored to the un-degraded threshold voltage.

In addition, during the sixth duration T6, the thirteenth transistor M13 of the fourth anti-noise circuit 260 is turned off, and the fifteenth transistor M15, the sixteenth transistor M16 and the seventeenth transistor M17 of the first negative bias compensation circuit 300 are turned on, and therefore the node PN connected to the control terminal of the thirteenth transistor M13 is pulled down to the second low system voltage VSS2 received by the second terminal of the sixteenth transistor M16 and the second terminal of the seventeenth transistor M17, such that the gate-to-source voltage (Vgs) of the thirteenth transistor M13 is identical to the second low system voltage VSS2 minus the first low system voltage VSS (e.g., (−10V)−(−6V)=(−4V)). Accordingly, the cross-voltage Vgs of the thirteenth transistor M13 causes the negative bias compensation to be occurred on the thirteenth transistor M13. The electrons trapped by the defects of the insulator layer of the thirteenth transistor M13 could be effectively eliminated through the negative bias compensation, such that the threshold voltage of the thirteenth transistor M13 could be restored to the un-degraded threshold voltage.

Specifically, during the sixth duration T6, the lower cross-voltage Vgs of the turned off twelfth transistor M12 could extend the life of the single-stage gate driving circuit at the high temperature environment. Therefore, the single-stage gate driving circuit of the present invention can be more reliable in extreme temperature environments and can pass the stress test at the high temperature environment.

Then, during a seventh duration T7 and a eighth duration T8, the clock signal CLK3 received by the first terminal and the control terminal of the fifteenth transistor M15 is pulled up from the low voltage level to the high voltage level, such that the node PN connected to the second terminal of the turned on fifteenth transistor M15 is pulled up to a voltage level that is identical to the high voltage level minus the threshold voltage of the fifteenth transistor M15.

Accordingly, the higher voltage level of the node PN causes the eighth transistor M8 of the first anti-noise circuit 150 to be turned on, and the turned on eighth transistor M8 causes the node QN connected to the first terminal of the eighth transistor M8 to be maintained at the first low system voltage VSS received by the second terminal of the eighth transistor M8, thereby preventing noise generation under the sleep mode (i.e., the seventh duration T7 and the eighth duration T8). In the meantime, the higher voltage level of the node PN causes the tenth transistor M10 of the second anti-noise circuit 160 to be turned on, and the turned on tenth transistor M10 causes the gate driving signal GN received by the first terminal of the tenth transistor M10 to be maintained at the first low system voltage VSS received by the second terminal of the tenth transistor M10, thereby preventing noise generation under the sleep mode (i.e., the seventh duration T7 and the eighth duration T8). In the meantime, the higher voltage level of the node PN causes the twelfth transistor M12 of the third anti-noise circuit 250 to be turned on, and the turned on twelfth transistor M12 causes the node QN+1 connected to the first terminal of the twelfth transistor M12 to be maintained at the first low system voltage VSS received by the second terminal of the twelfth transistor M12, thereby preventing noise generation under the sleep mode (i.e., the seventh duration T7 and the eighth duration T8). In the meantime, the higher voltage level of the node PN causes the thirteenth transistor M13 of the fourth anti-noise circuit 260 to be turned on, and the turned on thirteenth transistor M13 causes the gate driving signal GN+1 received by the first terminal of the thirteenth transistor M13 to be maintained at the first low system voltage VSS received by the second terminal of the thirteenth transistor M13, thereby preventing noise generation under the sleep mode (i.e., the seventh duration T7 and the eighth duration T8).

In addition, during the seventh duration T7 and the eighth duration T8, the eleventh transistor M11 of the second anti-noise circuit 160 is turned off, and the eighteenth transistor M18, the nineteenth transistor M19 and the twentieth transistor M20 of the second negative bias compensation circuit 400 are turned on, and therefore the voltage level of the control terminal of the eleventh transistor M11 is pulled down to the second low system voltage VSS2 received by the second terminal of the nineteenth transistor M19 and the second terminal of the twentieth transistor M20, such that the gate-to-source voltage (Vgs) of the eleventh transistor M11 is identical to the second low system voltage VSS2 minus the first low system voltage VSS (e.g., (−10V)−(−6V)=(−4V)). Accordingly, the cross-voltage Vgs of the eleventh transistor M11 causes the negative bias compensation to be occurred on the eleventh transistor M11. The electrons trapped by the defects of the insulator layer of the eleventh transistor M11 could be effectively eliminated through the negative bias compensation, such that the threshold voltage of the eleventh transistor M11 could be restored to the un-degraded threshold voltage. In addition, during the seventh duration T7 and the eighth duration T8, the fourteenth transistor M14 of the fourth anti-noise circuit 260 is turned off, and the eighteenth transistor M18, the nineteenth transistor M19 and the twentieth transistor M20 of the second negative bias compensation circuit 400 are turned on, and therefore the voltage level of the control terminal of the fourteenth transistor M14 is pulled down to the second low system voltage VSS2 received by the second terminal of the nineteenth transistor M19 and the second terminal of the twentieth transistor M20, such that the gate-to-source voltage (Vgs) of the fourteenth transistor M14 is identical to the second low system voltage VSS2 minus the first low system voltage VSS (e.g., (−10V)−(−6V)=(−4V)). Accordingly, the cross-voltage Vgs of the fourteenth transistor M14 causes the negative bias compensation to be occurred on the fourteenth transistor M14. The electrons trapped by the defects of the insulator layer of the fourteenth transistor M14 could be effectively eliminated through the negative bias compensation, such that the threshold voltage of the fourteenth transistor M14 could be restored to the un-degraded threshold voltage.

After the eighth duration T8, under the sleep mode, the operation will be repeated the cycle from the sixth duration T6 to the eighth duration T8. Until the next updated cycle (of the operational mode) arrives, the operation will start from the first duration T1.

Specifically, under the sleep mode (i.e., from the sixth duration T6 to the eighth duration T8) of the single-stage gate driving circuit, the first anti-noise circuit 150, the second anti-noise circuit 160, the third anti-noise circuit 250 and/or the fourth anti-noise circuit 260 cause the voltage level of the node QN, the voltage level of the node QN+1, the voltage level of the gate driving signal GN and/or the voltage level of the gate driving signal GN+1 to be maintained at the first low system voltage VSS, thereby preventing noise generation under the sleep mode. Accordingly, a full time anti-noise display device could be realized, such that the requirement of low noise output of the gate driving circuit of the display device with narrow bezel could be met.

Further, under the sleep mode (i.e., from the sixth duration T6 to the eighth duration T8) of the single-stage gate driving circuit, by utilizing the negative bias compensation mechanism of the first negative bias compensation circuit 300 and/or the second negative bias compensation circuit 400, the threshold voltage(s) of the transistor(s) could be restored to the un-degraded threshold voltage(s), thereby improving the degradation of the transistor(s). Accordingly, regarding the problem that the positive shift of the threshold voltage of the transistor due to the long-term positive bias operation, the present invention utilizes the first negative bias compensation circuit 300 and the second negative bias compensation circuit 400 to compensate the threshold voltage(s) of the long-term operated transistor(s) so as to restore the threshold voltage(s), thereby improving the degradation of the transistor(s) and extending the life of the gate driving circuit.

Figure 5:
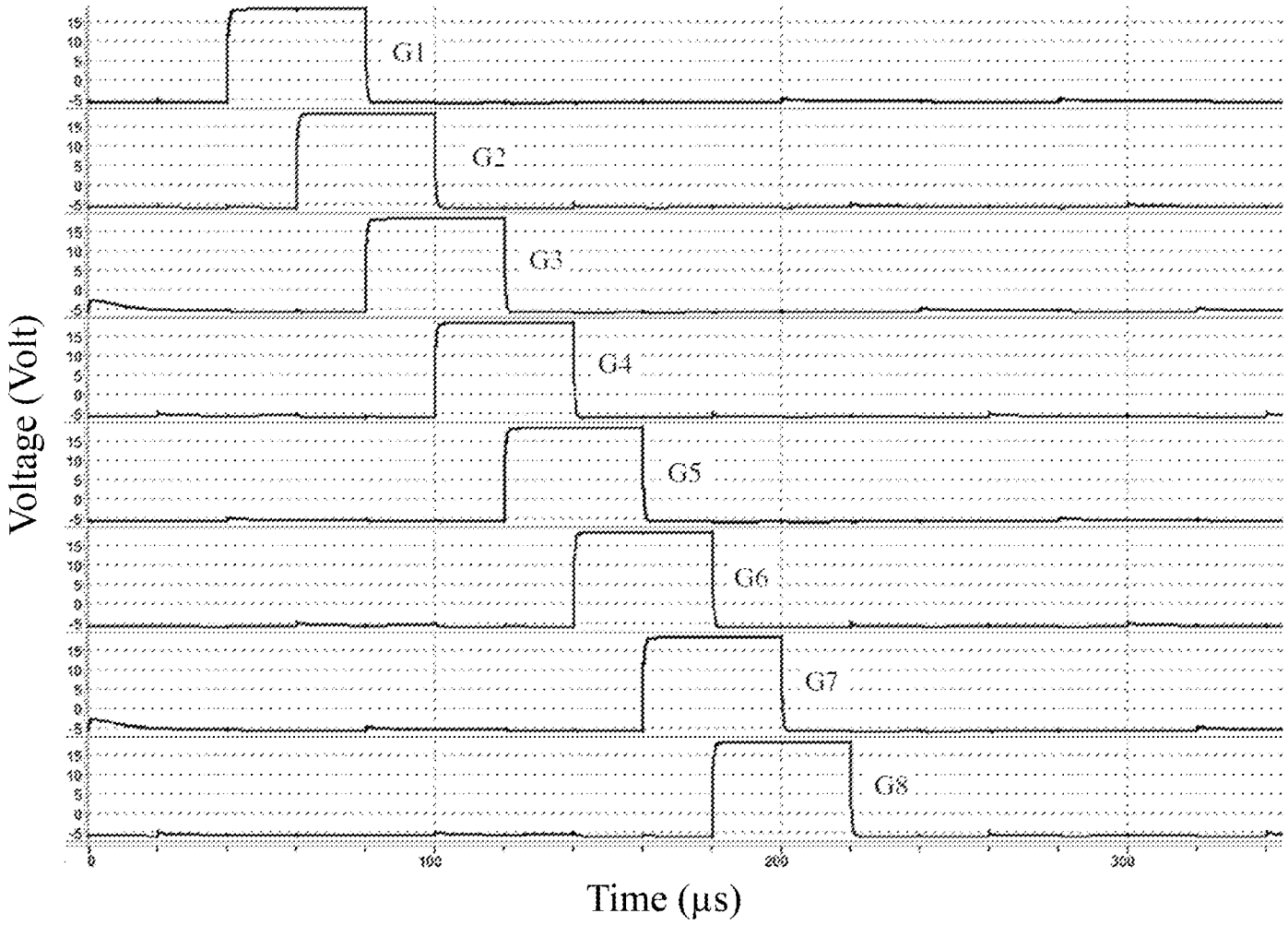
FIG. 5 illustrates a waveform diagram of the gate driving signal of the single-stage gate driving circuit at the at the high temperature environment according to some embodiments of the present invention.

Referring to the following FIG. 5 and table 1. FIG. 5 illustrates a waveform diagram of the gate driving signal of the single-stage gate driving circuit at the at the high temperature environment (i.e., 85° C.) according to some embodiments of the present invention. In FIG. 5, the horizontal axis represents the time (μs) and the vertical axis represents the voltage value (volt). The gate driving signal G1-G8 are shown in FIG. 5 and table 1. Table 1 shows the measurement results of the single-stage gate driving circuit at the high temperature environment (i.e., 85° C.).

TABLE 1

| | Noise (RMS) | Rising time (μs) | Falling time (μs) |
|---|---|---|---|
| G1 | 0.19 | 0.668 | 0.627 |
| G2 | 0.19 | 0.618 | 0.596 |
| G3 | 0.2 | 0.678 | 0.619 |
| G4 | 0.19 | 0.607 | 0.595 |
| G5 | 0.19 | 0.665 | 0.627 |
| G6 | 0.19 | 0.610 | 0.577 |
| G7 | 0.2 | 0.677 | 0.616 |
| G8 | 0.19 | 0.617 | 0.601 |

The rising time as shown in table 1 is defined as the time required for the voltage signal to rise from 10% to 90% when the voltage signal is charged from −6V (the first low system voltage VSS) to 18V (the high voltage level VDD).

The falling time as shown in table 1 is defined as the time required for the voltage signal to fall from 90% to 10% when the voltage signal is discharged from 18V (the high voltage level VDD) to −6V (the first low system voltage VSS). As shown in table 1, the single-stage gate driving circuit of the present invention has good rising time and good falling time (i.e., the fast rising time and the faster falling time), and the noise (RMS) is lower than 0.5. Further, the same kind of measurement values as shown in table 1 are slimier, and thus the driving voltage is stable, and the voltage level of the node QN and the voltage level of the node QN+1 could be presented as expected according to the designed circuit. Accordingly, the present invention realizes the multiple stages of voltage rise, thereby greatly improving the current driving capability.

In addition, as shown in FIG. 5 and table 1, the single-stage gate driving circuit of the present invention has a stable gate driving signal at the high temperature environment, thereby confirming that the single-stage gate driving circuit of the present invention can prevent current leakage and has anti-noise effect at the high temperature environment. Therefore, the single-stage gate driving circuit of the present invention can be more reliable in extreme temperature environments and can pass the stress test at the high temperature environment.

In addition, as shown in FIG. 5, the time intervals that the gate driving signals of the adjacent-stages of single-stage gate driving circuit (e.g., the gate driving signal G1 and the gate driving signal G2, or, the gate driving signal G2 and the gate driving signal G3, etc.) are at the high voltage level partially overlap with each other, thereby solving the problem of greatly reduced current driving capability caused by the low carrier mobility of a-Si at the low temperature. The aforementioned partially overlapping mechanism could provide the longer charging time, such that the gate driving signal could be charged to the specific voltage level, thereby solving the problem of insufficient charging at the low temperature environment. Accordingly, the single-stage gate driving circuit of the present invention can be more reliable in extreme temperature environments.

From the above description, the present invention provides a single-stage gate driving circuit. The single-stage gate driving circuit of the present invention realizes a structure of the single-stage gate driving circuit with multiple outputs, thereby reducing the number of the transistors of the single-stage gate driving circuit of the present invention, such that the layout area could be saved and the production costs could be reduce. In addition, the multiple stages of voltage rise are respectively occurred at the first/second bootstrapping capacitor C1/C2 during the different durations, such that the node QN/QN+1 of the single-stage gate driving circuit could be pulled up to a higher voltage level, and the gate driving signal has good rising time and good falling time, thereby greatly improving the current driving capability. In addition, the single-stage gate driving circuit of the present invention has negative bias compensation mechanism to improve the degradation of the transistor(s), thereby extending the life of the circuit. Further, the single-stage gate driving circuit of the present invention has anti-noise mechanism to realize the full time anti-noise display device.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A single-stage gate driving circuit with multiple outputs, comprising:

a first bootstrapping circuit;

a first pre-charge circuit connected to the first bootstrapping circuit through a first node, wherein the first pre-charge circuit precharges the first node to a first voltage during a first duration, wherein the first bootstrapping circuit boosts the first node from the first voltage to a second voltage during a second duration;

a first output control circuit connected to the first bootstrapping circuit and the first pre-charge circuit through the first node, wherein the first output control circuit boosts the first node from the second voltage to a third voltage during a third duration;

a second bootstrapping circuit connected to the first output control circuit;

a second pre-charge circuit connected to the second bootstrapping circuit through a second node, wherein the second pre-charge circuit precharges the second node to a fourth voltage during the second duration, wherein the second bootstrapping circuit boosts the second node from the fourth voltage to a fifth voltage during the third duration; and a second output control circuit connected to the second bootstrapping circuit and the second pre-charge circuit through the second node, wherein the second output control circuit boosts the second node from the fifth voltage to a sixth voltage during a fourth duration.

2. The single-stage gate driving circuit with multiple outputs of claim 1, wherein the first pre-charge circuit includes a first transistor, wherein a first terminal of the first transistor is connected to the first node, wherein a second terminal of the first transistor receives a high system voltage.

3. The single-stage gate driving circuit with multiple outputs of claim 1, further comprising:

a discharge circuit including a second transistor, wherein a first terminal of the second transistor is connected to the first node, wherein a second terminal of the second transistor receives a first low system voltage.

4. The single-stage gate driving circuit with multiple outputs of claim 3, wherein the first output control circuit includes a third transistor, wherein a control terminal of the third transistor is connected to the first node and a first terminal of the third transistor receives a first clock signal, such that the third transistor generates a first gate driving signal at a second terminal of the third transistor.

5. The single-stage gate driving circuit with multiple outputs of claim 2, wherein the first bootstrapping circuit is composed of a first bootstrapping capacitor and a fourth transistor, wherein a first terminal of the first bootstrapping capacitor is connected to the first node, wherein a second terminal of the first bootstrapping capacitor is connected to a first terminal of the fourth transistor.

6. The single-stage gate driving circuit with multiple outputs of claim 4, wherein the second bootstrapping circuit is composed of a second bootstrapping capacitor and a fifth transistor, wherein a first terminal of the second bootstrapping capacitor is connected to the second node, wherein a second terminal of the second bootstrapping capacitor is connected to a first terminal of the fifth transistor, wherein a second terminal of the fifth transistor is connected to the second terminal of the third transistor to receive the first gate driving signal.

7. The single-stage gate driving circuit with multiple outputs of claim 5, wherein the second pre-charge circuit includes a sixth transistor, wherein a first terminal of the sixth transistor is connected to the second node, wherein a second terminal of the sixth transistor receives the high system voltage.

8. The single-stage gate driving circuit with multiple outputs of claim 4, wherein the second output control circuit includes a seventh transistor, wherein a control terminal of the seventh transistor is connected to the second node and a first terminal of the seventh transistor receives a second clock signal, such that the seventh transistor generates a second gate driving signal at a second terminal of the seventh transistor.

9. The single-stage gate driving circuit with multiple outputs of claim 8, further comprising:

a first anti-noise circuit including an eighth transistor and a ninth transistor, wherein a first terminal of the eighth transistor and a first terminal of the ninth transistor are connected to the first node, wherein a second terminal of the eighth transistor and a second terminal of the ninth transistor receive the first low system voltage, wherein a control terminal of the eighth transistor is connected to a third node, wherein a control terminal of the ninth transistor is connected to a fourth node.

10. The single-stage gate driving circuit with multiple outputs of claim 9, further comprising:

a second anti-noise circuit including a tenth transistor and an eleventh transistor, wherein a first terminal of the tenth transistor and a first terminal of the eleventh transistor are connected to the second terminal of the third transistor, wherein a second terminal of the tenth transistor and a second terminal of the eleventh transistor receive the first low system voltage, wherein a control terminal of the tenth transistor is connected to the third node, wherein a control terminal of the eleventh transistor is connected to the fourth node.

11. The single-stage gate driving circuit with multiple outputs of claim 9, further comprising:

a third anti-noise circuit including a twelfth transistor, wherein a first terminal of the twelfth transistor is connected to the second node, wherein a second terminal of the twelfth transistor receives the first low system voltage, wherein a control terminal of the twelfth transistor is connected to the third node.

12. The single-stage gate driving circuit with multiple outputs of claim 9, further comprising:

a fourth anti-noise circuit including a thirteenth transistor and a fourteenth transistor, wherein a first terminal of the thirteenth transistor and a first terminal of the fourteenth transistor are connected to the second terminal of the seventh transistor, wherein a second terminal of the thirteenth transistor and a second terminal of the fourteenth transistor receive the first low system voltage, wherein a control terminal of the thirteenth transistor is connected to the third node, wherein a control terminal of the fourteenth transistor is connected to the fourth node.

13. The single-stage gate driving circuit with multiple outputs of claim 9, further comprising:

a first negative bias compensation circuit including a fifteenth transistor, a sixteenth transistor and a seventeenth transistor, wherein a first terminal and a control terminal of the fifteenth transistor receive the first clock signal, wherein a second terminal of the fifteenth transistor, a first terminal of the sixteenth transistor and a first terminal of the seventeenth transistor are connected to the third node, wherein a control terminal of the sixteenth transistor receives a third clock signal, wherein a control terminal of the seventeenth transistor is connected to the first node, wherein a second terminal of the sixteenth transistor and a second terminal of the seventeenth transistor receive a second low system voltage.

14. The single-stage gate driving circuit with multiple outputs of claim 13, further comprising:

a second negative bias compensation circuit including an eighteenth transistor, a nineteenth transistor and a twentieth transistor, wherein a first terminal and a control terminal of the eighteenth transistor receive the third clock signal, wherein a second terminal of the eighteenth transistor, a first terminal of the nineteenth transistor and a first terminal of the twentieth transistor are connected to the fourth node, wherein a control terminal of the nineteenth transistor receives the first clock signal, wherein a control terminal of the twentieth transistor is connected to the first node, wherein a second terminal of the nineteenth transistor and a second terminal of the twentieth transistor receive the second low system voltage.

15. The single-stage gate driving circuit with multiple outputs of claim 13, wherein the second low system voltage is less than the first low system voltage.

16. The single-stage gate driving circuit with multiple outputs of claim 2, wherein during the first duration, the first transistor is turned on such that the high system voltage received by the second terminal of the first transistor precharges the first node to the first voltage.

17. The single-stage gate driving circuit with multiple outputs of claim 5, wherein during the second duration, the fourth transistor is turned on and a high voltage level is provided to a second terminal of the fourth transistor, such that the first node is boosted from the first voltage to the second voltage, and the sixth transistor is turned on such that the high system voltage received by the second terminal of the sixth transistor precharges the second node to the fourth voltage.

18. The single-stage gate driving circuit with multiple outputs of claim 6, wherein during the third duration, the first terminal of the third transistor receives the first clock signal with a high voltage level such that the first node is boosted from the second voltage to the third voltage, and fifth transistor is turned on and the first gate driving signal received by the second terminal of the fifth transistor boosts the second node from the fourth voltage to the fifth voltage.

19. The single-stage gate driving circuit with multiple outputs of claim 8, wherein during the fourth duration, the first terminal of the seventh transistor receives the second clock signal with a high voltage level such that the second node is boosted from the fifth voltage to the sixth voltage.

20. A gate driving device, comprising:

a multi-stage of gate driving circuit composed of a plurality of gate driving circuits, wherein each of the gate driving circuits is configured to output at least two gate driving signals, wherein each of the gate driving circuits comprises:

a first bootstrapping circuit;

a first pre-charge circuit connected to the first bootstrapping circuit through a first node, wherein the first pre-charge circuit precharges the first node to a first voltage during a first duration, wherein the first bootstrapping circuit boosts the first node from the first voltage to a second voltage during a second duration;

a first output control circuit connected to the first bootstrapping circuit and the first pre-charge circuit through the first node, wherein the first output control circuit boosts the first node from the second voltage to a third voltage during a third duration;

a second bootstrapping circuit connected to the first output control circuit;

a second pre-charge circuit connected to the second bootstrapping circuit through a second node, wherein the second pre-charge circuit precharges the second node to a fourth voltage during the second duration, wherein the second bootstrapping circuit boosts the second node from the fourth voltage to a fifth voltage during the third duration; and a second output control circuit connected to the second bootstrapping circuit and the second pre-charge circuit through the second node, wherein the second output control circuit boosts the second node from the fifth voltage to a sixth voltage during a fourth duration.

* * * * *